US009068268B2

(12) United States Patent
Tarrant et al.

(10) Patent No.: US 9,068,268 B2
(45) Date of Patent: Jun. 30, 2015

(54) DISCRETE GALVANIC ANODE

(75) Inventors: Derek Tarrant, Kalispell, MT (US); Bradley W. Epperson, Piney Flats, TN (US); Gary Sean Carter, Bulls Gap, TN (US); Michael T. Mather, Greeneville, TN (US)

(73) Assignee: Jarden Zinc Products, LLC, Greeneville, TN (US)

( * ) Notice: Subject to any disclaimer, the term of this patent is extended or adjusted under 35 U.S.C. 154(b) by 617 days.

(21) Appl. No.: 13/379,584

(22) PCT Filed: Aug. 25, 2010

(86) PCT No.: PCT/US2010/046690

§ 371 (c)(1),
(2), (4) Date: Dec. 20, 2011

(87) PCT Pub. No.: WO2011/031494

PCT Pub. Date: Mar. 17, 2011

(65) Prior Publication Data

US 2012/0152732 A1 Jun. 21, 2012

Related U.S. Application Data

(60) Provisional application No. 61/236,716, filed on Aug. 25, 2009.

(51) Int. Cl.

| | |
|---|---|
| ***C23F 13/00*** | (2006.01) |
| ***C23F 13/10*** | (2006.01) |
| ***C23F 13/18*** | (2006.01) |
| ***C23F 13/20*** | (2006.01) |

(52) U.S. Cl.

CPC ..... *C23F 13/10* (2013.01); *Y10T 29/49826* (2015.01); *C23F 13/18* (2013.01); *C23F 13/20* (2013.01); *C23F 2201/02* (2013.01)

(58) Field of Classification Search

CPC ..... C23F 13/10; C23F 13/18; C23F 2201/02; C23F 13/08

USPC ..... 204/196.3, 196.33, 196.34, 196.36; 205/734

See application file for complete search history.

(56) References Cited

U.S. PATENT DOCUMENTS

| | | | | |
|---|---|---|---|---|
| 6,193,857 | B1 * | 2/2001 | Davison et al. | 204/196.01 |
| 6,461,082 | B1 * | 10/2002 | Smith | 405/211.1 |
| 6,562,229 | B1 * | 5/2003 | Burgher et al. | 205/724 |
| 7,488,410 | B2 * | 2/2009 | Bennett et al. | 205/734 |
| 7,648,623 | B2 * | 1/2010 | Glass | 205/734 |
| 2007/0194774 | A1 * | 8/2007 | Bennett et al. | 324/71.2 |

* cited by examiner

*Primary Examiner* — Luan Van
*Assistant Examiner* — Alexander W Keeling
(74) *Attorney, Agent, or Firm* — Lawrence J. Shurupoff

(57) ABSTRACT

A discrete sacrificial zinc anode is fabricated from one or more slotted and slatted metal plates. The plates are fixed in a parallel planar configuration using conventional fasteners. One or more electrical connection wires are formed with a looped portion for spacing the anode assembly a predetermined distance from a steel reinforcing member.

17 Claims, 8 Drawing Sheets

FIG 1
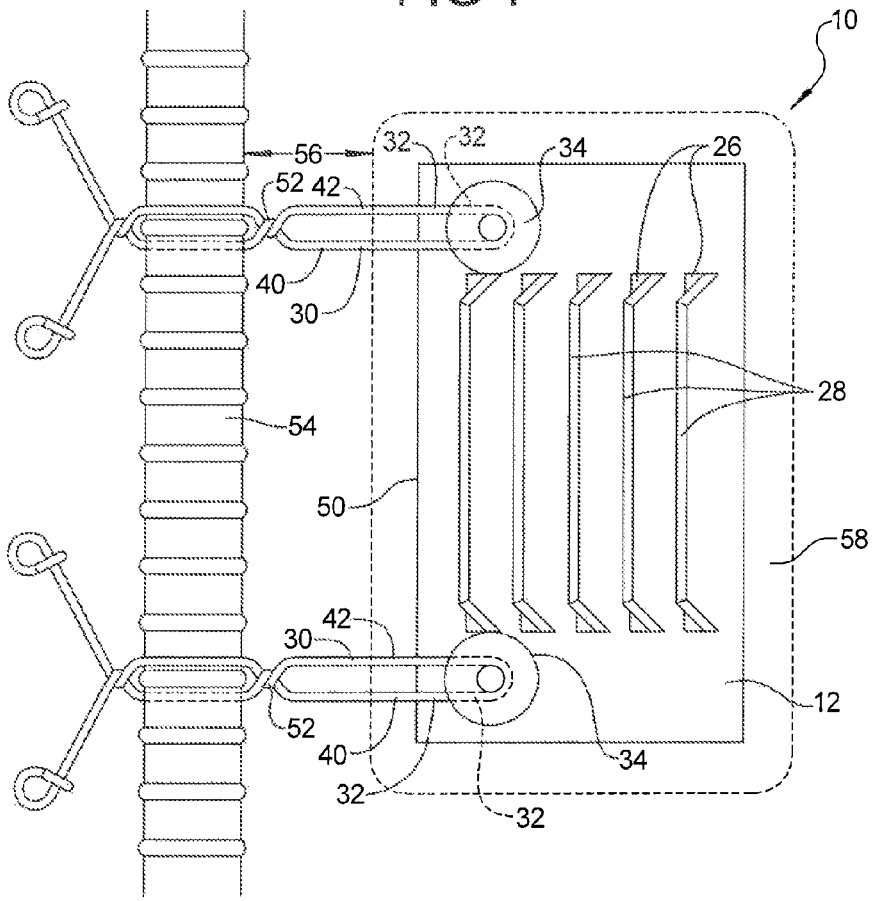
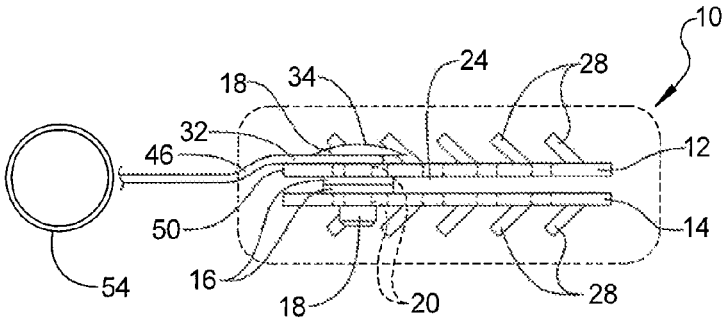
FIG 2

DISCRETE GALVANIC ANODE

BACKGROUND

Conventional sacrificial anodes are available in the form of discrete galvanic zinc anodes which are embeddable within steel-reinforced concrete. These anodes are typically formed as solid cast blocks of zinc with limited surface area compared to their weight, or are made from one or more pieces of expanded zinc mesh gathered together. Both types of zinc anodes are embedded within a casing of conductive mortar which facilitates the corrosion of the anode material and enables a protective galvanic current to flow when the anodes are connected to steel reinforcement within a concrete covering. Examples are shown in U.S. Pat. Nos. 6,193,857 and 6,022,469.

Conventional discrete embeddable anodes typically do not have any mechanism for spacing them apart from the steel reinforcing rods or "rebars" they are fitted to, apart from the thickness of the covering mortar and/or an integral plastic barrier. Close proximity to the steel reinforcing member or rebar increases galvanic activity (and hence protection) in the immediate vicinity of the sacrificial anode at the expense of activity and protection applied to more distant parts of the steel reinforcement.

One product currently on the market achieves greater anode surface area by using pieces of expanded zinc mesh soldered to one or more ductile iron wires that carry the protective current to the steel reinforcement. Another product currently on the market makes use of an integral plastic barrier to inhibit the passage of protective current in areas in the immediate vicinity of the steel anode interface, forcing the current further away from the point of contact. While these conventional anodes function adequately, it would be desirable to improve the useful life and function of such anodes while facilitating their proper installation and spacing from a steel structure, such as a steel reinforcing bar embedded in concrete.

SUMMARY OF THE DISCLOSURE

This disclosure covers an anode assembly having a unique flat anode plate design. The anode plates can be formed with or without slats, louvers or raised strips or ribs which are stamped from or cut into the surface of the anode. The use or one or more flat metal plates in place of a solid metal casting allows for the fabrication of anodes having much greater surface area. This allows for greater flow of protective current and reduces the tendency of the anode to passivate in service.

This disclosure also covers fabricated ductile iron wire connectors which space the metal anode some predetermined distance away from the steel reinforcement. This reduces the intensity of protective current and reduces the tendency of the anode to passivate in service.

A conductive solid electrolytic mortar material is also employed. A preferred mortar functions well below the conventional passivation threshold for zinc and allows the zinc anode to stay active in pH environments which otherwise would passivate the anode surface, shut down the electrochemical functioning of the anode and prevent galvanic protection of the steel to which it is connected.

The galvanic anode design disclosed herein has unique design features that greatly increase surface area compared to solid cast anodes. Specially designed slats formed in the face of a sheet of anode material can open up an extra 7.8% anode surface area as compared to a solid anode sheet. The slats, louvers or raised strips produce openings or slits which allow unrestricted movement of ions from portions of both surfaces of the anode sheets eliminating any "shadow" effect and allowing both sides of the anode panel to contribute to the galvanic protection of the steel.

The slats, louvers and raised strips also provide physical anchor points for conductive mortar to bond onto and contribute to the overall strength of the anode assembly.

A 150 gram zinc anode designed in accordance with this disclosure has a surface area of 42 sq in. This represents an increase of 4.74 times the surface area of a commercially available anode at the same anode weight. Other anodes designed in accordance with this disclosure offer a minimum of 4.95 times and 2.8 times the surface area of conventional solid anodes.

Slatted, louvered, ribbed and similarly configured anode panels with projections such as described below can be assembled, in stacked pairs to provide additional anchoring for the conductive mortar. Double-stacked slatted and slotted anode plates place the zinc anodes close to the external surface of the anode assembly for optimum ionic transfer to the surrounding concrete fill medium.

The electrical and mechanical connection points from the anode can be provided as annealed steel wires. These wires are uniquely configured to produce a "stand off" placement of the mortar encased anode with respect to the steel which it must protect. This reduces the peak current flow to adjacent areas of the steel and facilitates higher current areas in locations further away from the anode assembly mounting point. This makes the anode assembly more efficient overall. Anode separation is largely determined by the furthest distance from itself that an anode can satisfactorily protect the steel to which it is attached. This "stand off" mounting technique boosts the anode efficiency at long distances thus allowing greater separation between multiple anodes for equal coverage in a structure using fewer anodes.

BRIEF DESCRIPTION OF THE DRAWINGS

In the drawings:

FIG. 1 is a top view of a representative galvanic anode assembly constructed in accordance with the present disclosure and showing in phantom a conductive mortar material in which an anode plate is embedded;

FIG. 2 is a partial side view of FIG. 1;

In the various views of the drawings, like reference numerals represent like or similar parts.

DETAILED DESCRIPTION OF REPRESENTATIVE EMBODIMENTS

Figure 3:
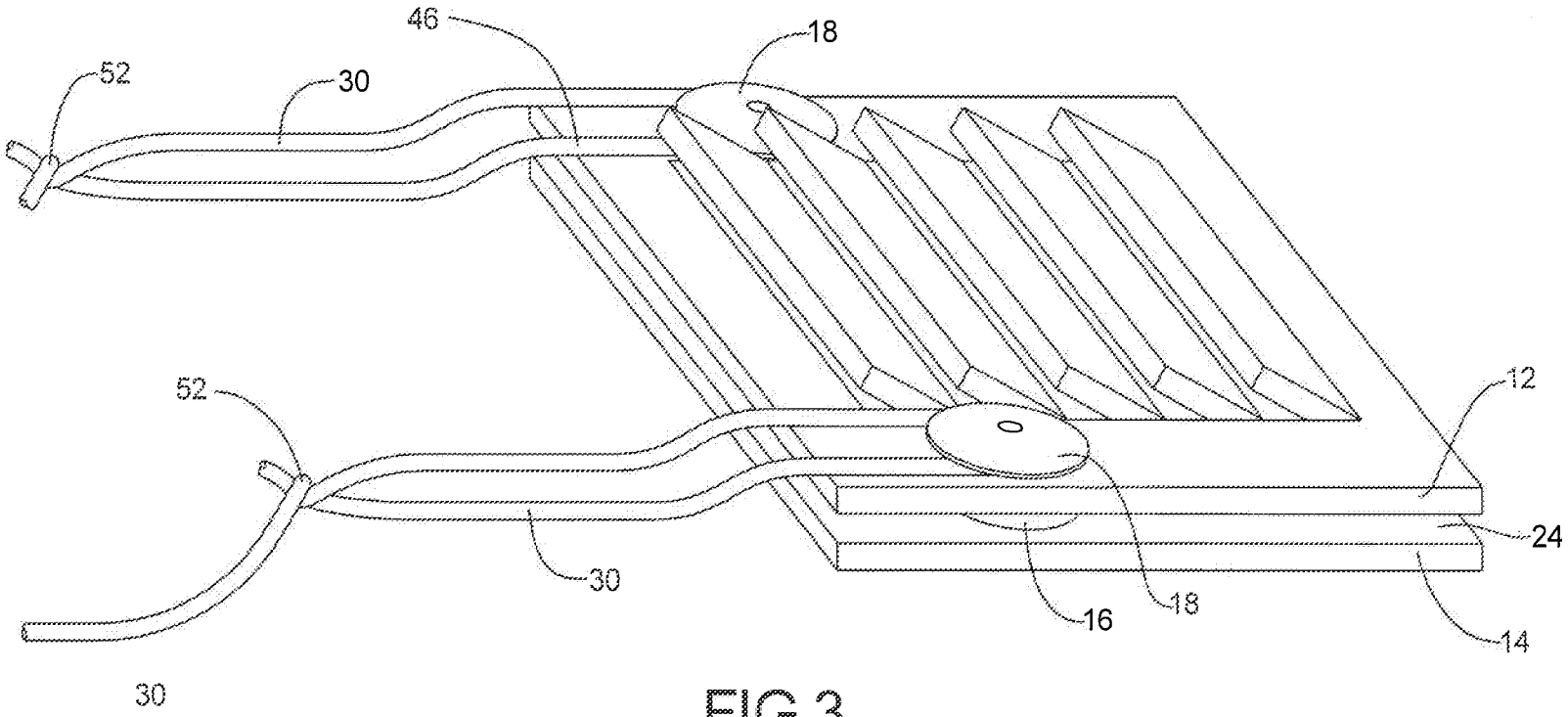
FIG. 3 is a partial top perspective view of a slatted and louvered anode plate assembly prior to its encapsulation in a block of galvanic mortar.

As generally seen in FIGS. 1-9, a discrete galvanic anode is constructed from one or more sheets or plates of galvanic metal such as zinc and alloys of zinc. The sheets or plates are preferably formed with slats to open up the otherwise planar structure of the sheets or plates. Typically, this is by means of a simple punching operation, but could be by means of machined slits or holes.

Ductile steel connector wires are twisted together at a distance from the body of the anode material such that the finished anode, which is encased within an electrolytically conductive mortar, is separated some predetermined distance away from the steel reinforcement when the ductile wires are twisted around the steel reinforcement. The pre-formed ductile wires also facilitate a tighter final connection to the reinforcing steel. In particular, the wires are shaped to form an open saddle-shaped loop for closely receiving and engaging the outer surface of a steel reinforcing bar. The distance between the open saddle-shaped loop and the anode defines the spacing between the anode and a steel reinforcement or rebar which is subsequently nested within the loop by bending and/or twisting the wires around the reinforcement or rebar.

As more particularly seen in FIGS. 1 and 2, an electrolytic galvanic anode assembly 10 is fabricated from one or more metal plates 12, 14 (FIG. 2). The plates can be formed of any galvanically active metal. In one embodiment, both the upper plate 12 and lower plate 14 are formed of zinc or an alloy of zinc and can be formed as rectangular sheets measuring about four inches long, about two and a quarter inches wide and about one sixteenth of an inch thick.

The plates 12, 14 are spaced apart by about, for example, one-eighth inch by one or more electrically conductive washers 16. A conventional fastener, such as a nut and bolt, a metal screw or a rivet 18 is driven through each hole 20 (FIG. 2) formed through each plate 12, 14. The fasteners 18 provide an electrical connection between the plates 12, 14 as well as wire 30 as discussed below. The clamping force applied by the fasteners 18 aligns the two plates 12, 14 substantially parallel with one another so as to define a substantially fixed or constant spacing or gap 24 between the plates. In some cases, gap 24 can provide a space for receiving corrosion products produced from the gradual corrosion of plates 12, 14.

Prior to assembly, each plate 12, 14 is formed with one or more holes or slots 26 by punching, machining, drilling, or any other forming or cutting process. Instead of slots, circular, irregular or any other shaped hole may be formed through the plates 12, 14. As seen in the Figures, a series or plurality of projections such as of slats, ribs or louvers 28 is formed in each plate 12, 14 from the material punched from slots 26. These projections extend outwardly from the planes of the plates 12, 14 in opposite directions. The projections can also be attached to the plates as separate ribs or slats such as by welding.

An electrically conductive wire 30, such as a solid steel wire is formed with a closed first loop 32 which is dimensioned to fit beneath the head 34 of each fastener 18 during the initial fabrication of the anode assembly 10. One end of the loop 32 is clamped beneath the fastener head 34 with a tight fit during the assembly of the washers 16 and plates 12, 14.

The conductive wire 30 is formed with two parallel leg portions 40, 42 which extend, for example, about one and three quarter inches from the holes 20 and generally perpendicular to the length of the upper plate 12. As seen in FIG. 2, each leg 40, 42 is formed with a bend or elbow 46 adjacent and over the rear edge 50 of plate 12.

As seen in FIG. 1, the end of loop 32 opposite hole 20 is formed with one or more spiral twists 52. Twists 52 set a predetermined distance or spacing 56 (FIG. 1) between the anode assembly 10 and a steel reinforcement such as a steel rebar 54. The twists 52 close the loop 32 so that the loop 32 extends a predetermined distance from the plates 12, 14 and from any covering cement or mortar 58. As discussed below, when a rebar or reinforcement is positioned adjacent the twists, a predetermined spacing is established between the reinforcement 54 and the plates 12, 14 and the anode assembly 10.

To complete the production of the anode assembly 10, the plates 12, 14 are coated or embedded within a covering of electrolytic conductive mortar 58 as shown in phantom in FIGS. 1 and 2. Mortar 58 is commercially available and can be cast, molded, sprayed or otherwise formed around and between the plates 12, 14 and a portion of the loop 32. In one embodiment, the outer dimensions of the substantially rectangular block of mortar are four and a half inches long, two and three quarter inches wide and one inch thick.

The slats or louvers 28 act as anchors for the mortar 58 when it is applied wet and also when solid after drying. The slats or louvers 28 also increase the surface area of the plates 12, 14 in contact with the mortar and allow the mortar to flow at least partially into gap 24 through slots 26.

FIG. 3 shows a subassembly of the plates 12, 14, washers 16, fasteners 18 and steel wires 30 prior to encasement, in mortar.

Figure 4:
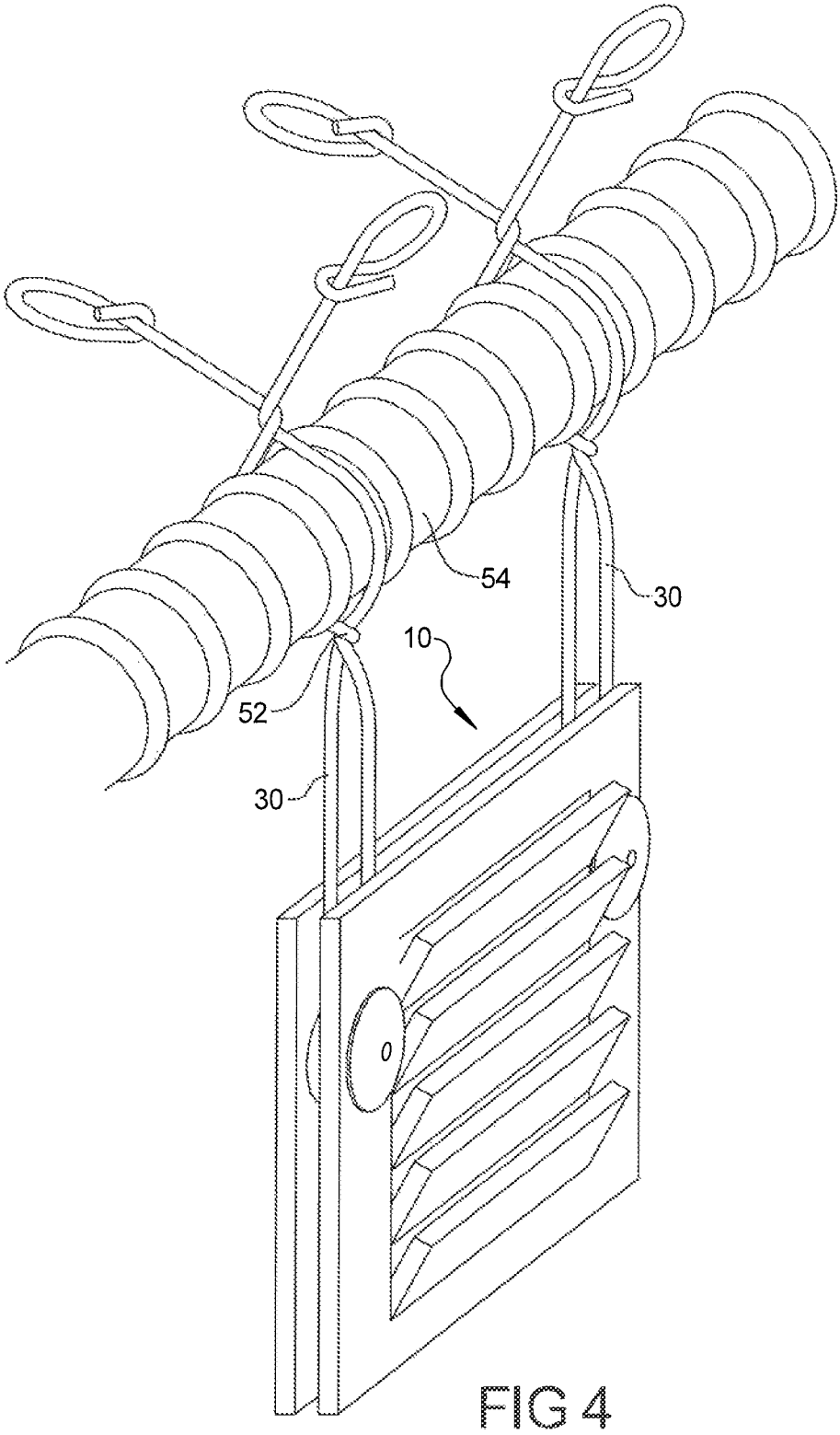
FIG. 4 is a perspective view of an alternate embodiment of an anode plate shown attached to a steel reinforcement or "rebar"

FIG. 4 shows a subassembly similar to FIG. 3, but in this embodiment, the washers 16 are eliminated and one end of loop 32 serves as a spacer between the plates. That is, loop 32 is clamped between the plates 12, 14 instead of on top of the outer surface of plate 12 as shown in FIGS. 1 and 2. FIG. 4 also illustrates how the loop 32 separates the plates 12, 14 from a steel reinforcement 54 by abutment of the twists 52 in wire 30 with rebar 54.

Figure 5:
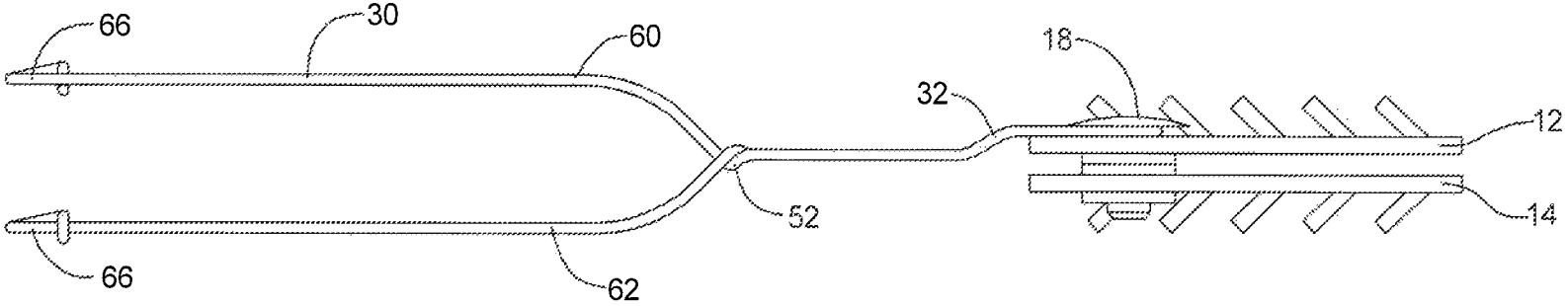
FIG. 5 is a full side view of the anode subassembly of FIG. 3.

A side view of FIG. 3 is shown in FIG. 5, wherein the free ends of wire 30 extend beyond the closed loop 32 and beyond spiral twists 52 in the form of a pair of parallel open arms 60, 62 forming an open loop or pocket between them for receiving a rebar or the like. The ends of each arm 60, 62 may optionally be formed into a ring or coiled portion 66 to facilitate manual twisting and connection of the anode assembly 10 to a reinforcing member or rebar 54. Arms 60, 62 can be dimensioned with a length of about, for example, 2½ to 3 inches. The plane in which the arms 60, 62 extend is substantially perpendicular to the plane in which the legs 40, 42 of loop 32 extend, and perpendicular to the planes of the plates 12, 14. This arrangement results in the alignment of the anode assembly 10 substantially parallel to the rebar 54 as seen in FIGS. 4 and 6.

As further shown in FIGS. 1 and 4, arms 60, 62 can be bent and twisted around a rebar 54 to form a second closed loop to hold the anode assembly 10 in place. It should be noted that for the sake of clarity, the subassemblies shown in FIGS. 3, 4 and 5 do not include a covering of mortar 58 as shown in phantom in FIGS. 1 and 2. In FIGS. 3, 4 and 5, the mortar covering 58 is removed for clarity to show the location of the plates 12, 14 with respect to the rebar 54 and the other anode assembly components.

In an alternate embodiment, the plates 12, 14 can be provided in the form of one or more sheets of expanded metal mesh.

Figure 6:
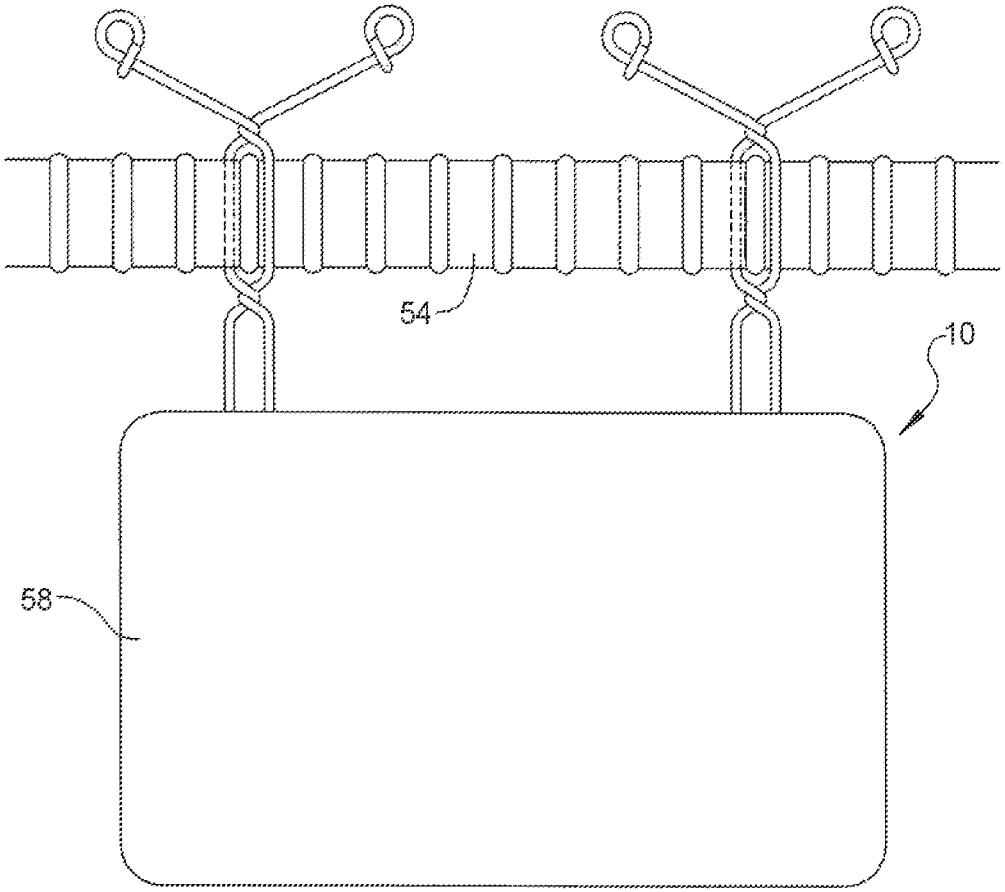
FIG. 6 is a view of a complete anode assembly such as shown in FIGS. 1-5 encased in mortar and shown in a representative application mounted to a steel reinforcement bar.

In actual use in the field, an anode assembly 10 as shown in FIG. 6 is covered with conductive mortar 58. The anode assembly of FIG. 6 has, for example, dimensions of about 4¼ inch in length, 2¾ inches in width and ⅝ inch in thickness.

Once the anode assembly 10 is mounted to a steel member such as rebar 54, wet concrete is poured over and around the rebar and anode assembly 10 and allowed to set in a known fashion. The anode assembly 10 can be used for both new concrete construction and for concrete repairs.

Figure 7:
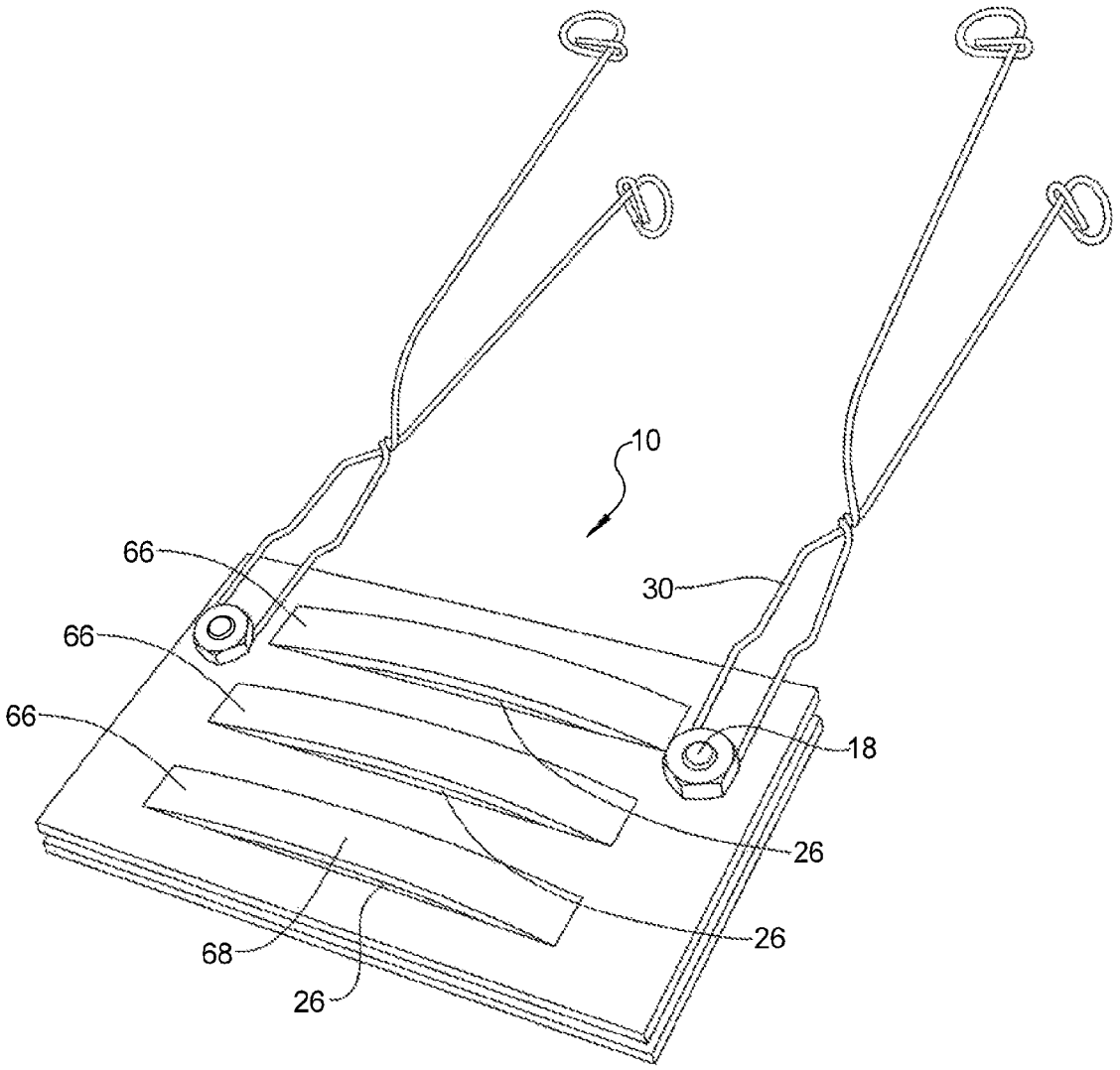
FIG. 7 is a top perspective view of an alternate embodiment of a slatted anode plate assembly.
Figure 8:
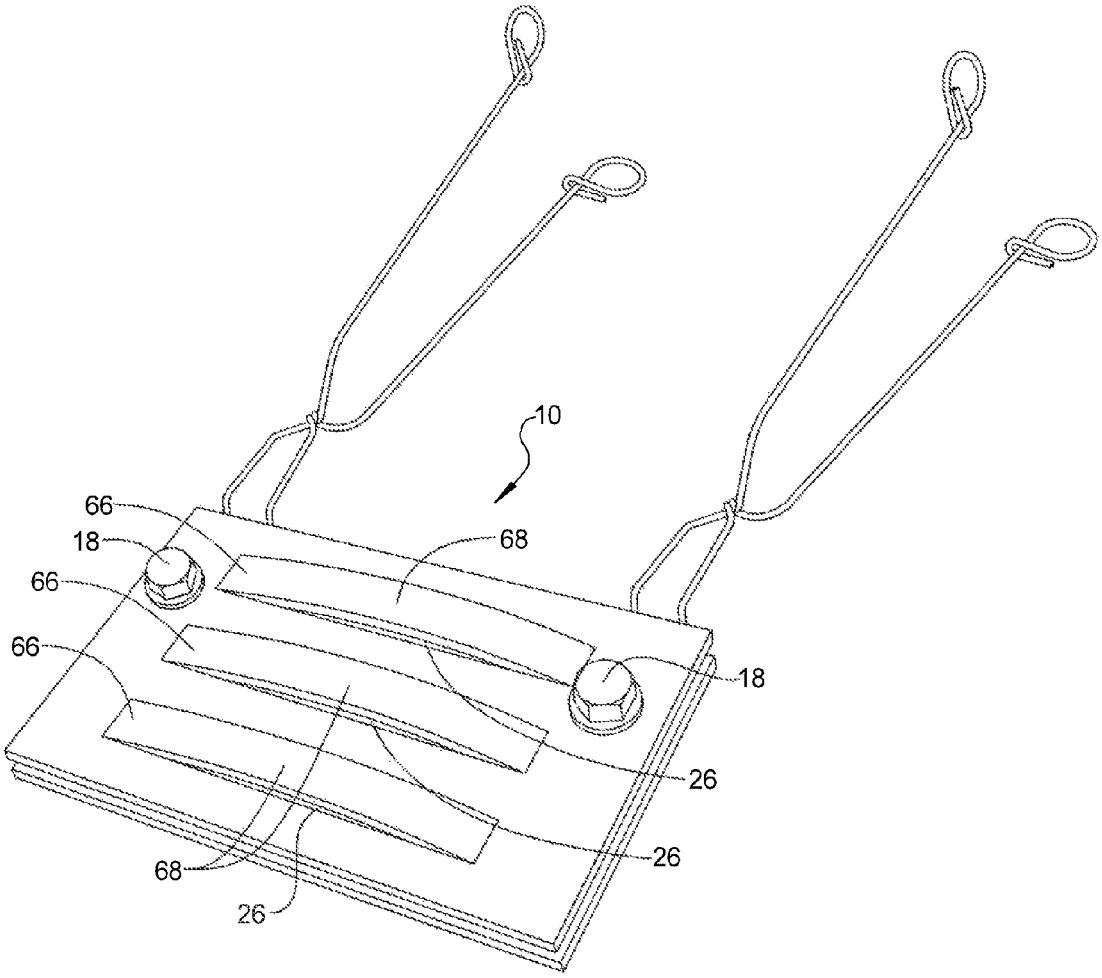
FIG. 8 is a bottom perspective view of FIG. 7.
Figure 9:
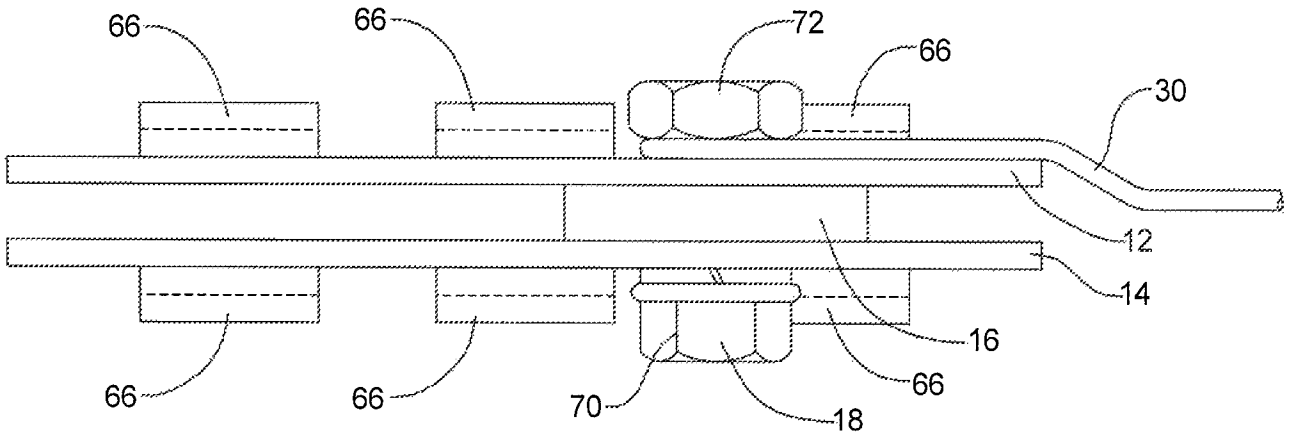
FIG. 9 is a partial side view of FIG. 7.

Another embodiment of the disclosure is shown in FIGS. 7, 8 and 9 wherein an anode assembly 10 is formed with arch-shaped slats 66 overlying rectangular openings or slots 26 from which the slats 66 are punched out or otherwise formed. The slats 66 can be arranged as a series of evenly-spaced symmetrical arcs having an apex 68 at a central or center portion of each plate 12, 14. The rectangular slats 66 can be arranged in a mutually parallel relationship as shown. The slats 66 can be formed across the major or minor dimension of each plate, or diagonally across each plate 10, 12.

As seen in FIG. 9, fastener 18 includes a bolt 70, a nut 72 and a lock washer 16 located between the plates 12, 14. In this manner, the wire 30 is securely clamped to plate 12 under nut 72. It is of course possible to stack more than two plates 12, 14 together to form an anode subassembly. Additional plates can be stacked onto plates 12, 14 by adding washers 16 between each additional plate and clamping the tiered subassembly together as described above.

It will be appreciated by those skilled in the art that the above discrete galvanic anode is merely representative of the many possible embodiments of the invention and that the scope of the invention should not be limited thereto, but instead should only be limited according to the following claims.

What is claimed is:

1. An anode assembly, comprising:

a first metal plate having a plurality of projections extending outwardly from said first metal plate;

a second metal plate having a plurality of projections extending outwardly from said second metal plate;

a fastener coupling said first metal plate to said second metal plate;

a wire fastened to said first metal plate;

a washer disposed between said first and second metal plates; and a mortar covering said first and second metal plates.

2. The assembly of claim 1, wherein said first and second metal plates extend substantially parallel with one another and define a gap therebetween.

3. The assembly of claim 1, wherein said first metal plate has a plurality of slots formed therethrough adjacent said plurality of projections.

4. The assembly of claim 1, wherein said plurality of projections comprises a plurality of slats.

5. The assembly of claim 2, wherein said first metal plate is electrically connected to said second metal plate by said fastener.

6. The anode assembly of claim 1, wherein said first metal plate comprises zinc.

7. The anode assembly of claim 1, wherein said wire further comprises a twisted portion and a pair of arms extending from said twisted portion.

8. The anode assembly of claim 7, further comprising an opening formed between said pair of arms for receiving a steel reinforcement.

9. The anode assembly of claim 1, wherein said wire is formed with a loop fastened to said first metal plate.

10. The anode assembly of claim 1, wherein said wire is clamped between said first and second metal plates.

11. The anode assembly of claim 1, further comprising a steel reinforcement member and wherein said wire is formed with a first loop fastened to said metal plate and a second loop bent around said steel reinforcement member.

12. An anode assembly, comprising:

a first metal plate having a plurality of projections extending outwardly from said first metal plate;

a second metal plate having a plurality of projections extending outwardly from said second metal plate;

a wire fastened to said first metal plate;

a mortar covering said first and second metal plates; and a fastener coupling said first metal plate to said second metal plate and clamping said wire to said first metal plate.

13. An anode assembly, comprising:

a first metal plate extending in a first plane and having a plurality of projections extending outwardly therefrom;

an electrically conductive wire formed in a first closed loop extending adjacent to said first plane and electrically coupled at a first end portion to said first metal plate;

a mortar covering said first metal plate and said first end portion of said first closed loop;

said first closed loop extending outwardly from said mortar and extending into a twisted portion; and said electrically conductive wire having a pair of free end wire portions extending from said twisted portion in a second plane substantially perpendicular to said first plane for aligning said first metal plate with a steel reinforcement member.

14. The anode assembly of claim 13, wherein said pair of free end wire portions are formed in an open saddle-shaped loop for engaging the outer surface of a steel reinforcement member.

15. The anode assembly of claim 14, further comprising a steel reinforcement member disposed closely within said saddle-shaped loop.

16. The anode assembly of claim 15, wherein said first metal plate extends substantially parallel to said steel reinforcement member.

17. The anode assembly of claim 13, wherein said twisted portion is spaced apart from said first metal plate and said mortar by a predetermined distance so as to space a steel reinforcement member a predetermined distance from said first metal plate and said mortar when a steel reinforcement member is held between said free end portions adjacent said twisted portion.

* * * * *